US010036240B2

(12) United States Patent
Lubrecht et al.

(10) Patent No.: US 10,036,240 B2
(45) Date of Patent: Jul. 31, 2018

(54) DRILLHEAD ASSEMBLY WITH CHAMBERED SONDE HOUSING

(71) Applicant: Directed Technologies Drilling, Inc., Bremerton, WA (US)

(72) Inventors: Michael D Lubrecht, Monroe, WA (US); James M Doesburg, Gig Harbor, WA (US); Daniel W Ombalski, State College, PA (US)

(73) Assignee: DIRECTED TECHNOLOGIES DRILLING, INC., Bellefonte, PA (US)

( * ) Notice: Subject to any disclaimer, the term of this patent is extended or adjusted under 35 U.S.C. 154(b) by 52 days.

(21) Appl. No.: 14/935,280

(22) Filed: Nov. 6, 2015

(65) Prior Publication Data

US 2016/0061024 A1 Mar. 3, 2016

Related U.S. Application Data

(63) Continuation-in-part of application No. 14/517,905, filed on Oct. 19, 2014, which is a continuation of application No. 13/543,554, filed on Jul. 6, 2012, now Pat. No. 9,376,869.

(60) Provisional application No. 61/523,253, filed on Aug. 12, 2011, provisional application No. 62/076,259, filed on Nov. 6, 2014.

(51) Int. Cl.

| | |
|---|---|
| ***E21B 47/01*** | (2012.01) |
| ***E21B 47/024*** | (2006.01) |
| ***E21B 7/04*** | (2006.01) |
| ***E21B 7/128*** | (2006.01) |

(52) U.S. Cl.

CPC ..... *E21B 47/01* (2013.01); *E21B 7/046* (2013.01); *E21B 7/128* (2013.01); *E21B 47/011* (2013.01); *E21B 47/024* (2013.01)

(58) Field of Classification Search

CPC ..... E21B 47/01; E21B 47/07; E21B 47/124; E21B 47/122; E21B 47/011

See application file for complete search history.

(56) References Cited

U.S. PATENT DOCUMENTS

| | | | | |
|---|---|---|---|---|
| 5,490,569 A * | 2/1996 | Brotherton | ..... | E21B 7/062 175/45 |
| 2009/0173493 A1* | 7/2009 | Hutin | ..... | E21B 17/003 166/250.01 |
| 2011/0061454 A1* | 3/2011 | Vornbrock | ..... | E21B 7/046 73/152.58 |

* cited by examiner

*Primary Examiner* — Brad Harcourt
(74) *Attorney, Agent, or Firm* — Lane Powell PC

(57) ABSTRACT

A drill assembly with a drill body coupled to a drilling string and a sonde body having a least one chamber defined therein for receiving locating electronics therein. In disclosed embodiment, the one or more chambers may be provided and the electronics can include a battery, a sensor, a transmitter, an antenna and connecting wires. One or more secure windows may be provided in the sonde body to allow the locating electronics to wirelessly transmit outside of the sonde body. The electronics may be potted within the chamber with a solidifying potting agent to improve durability of the electronics in a drilling environment.

15 Claims, 16 Drawing Sheets

Double Ended Installation Process 200

Single Ended Installation
300

Single Ended Knock-Off Installation 500

Single Ended Knock-Off Installation 600

Offset Sonde
Housing-End View
800

Process for Disengaging or Knocking Off a Drill Bit
1100

Knockoff Bit Assembly Drilling Configuration 1200

Knockoff Bit Assembly
Drill Bit Knocked Off
1400

DRILLHEAD ASSEMBLY WITH CHAMBERED SONDE HOUSING

CROSS-REFERENCE TO RELATED APPLICATIONS

The application is a continuation-in-part of U.S. patent application Ser. No. 14/517,905 filed on Oct. 19, 2014, and claims priority to U.S. patent application Ser. No. 13/543,554, filed on Jul. 6, 2012, U.S. provisional patent application Ser. No. 62/076,259 filed on Nov. 6, 2014, and Ser. No. 61/523,253 filed on Aug. 12, 2011, all of the disclosures of which are hereby incorporated by reference.

TECHNICAL FIELD

The present invention relates generally to enhancing navigation capabilities for locating equipment used in horizontal directional drilling, and more specifically it relates to extending the operating range and increasing the operating modes of the current locating tools.

BACKGROUND

Directional boring, commonly called horizontal directional drilling, is a steerable trenchless method of installing underground pipes, conduits and cables or the like in a shallow arc, along a prescribed subsurface bore path by using a specialized drilling rig. The drilling assembly that creates the boring is surface launched at a shallow angle and is steered along the predetermined path.

Pipes laid, or well casing installed in this manner can be made of materials such as iron, steel, PVC, polyethylene, polypropylene, or the like.

Products installed by directional drilling are typically used for utilities transmission or distribution, water supply, or remediation of contaminated soil or groundwater.

With this type of drilling there is typically minimal impact on the surrounding area compared to trenching or other alternatives. Directional boring can often be used when trenching or excavating is not practical, such as under roadways, or other existing structures. It is suitable for a variety of soil and rock conditions.

One feature of horizontal directional drilling is the incorporation of electronic locating equipment that enables the driller or another crew member to determine the relative position of the drill head in three dimensions and in real time. This information—typically X and Y coordinates along the ground surface, the depth below ground surface, and the current pitch or angle of the drill bit—is used to determine if the bore is being advanced along the desired path and to enable the driller to make steering corrections as necessary to maintain the path.

Electronic locating equipment may be supplied in several forms and uses several different technologies. The simplest, easiest to employ, and least expensive locating equipment is battery powered and comprises a combination of an instrument package that is placed in a housing behind the drill bit (the "sonde" and "sonde housing") and a receiver assembly (the "receiver") that is carried by a technician at the ground surface along the bore path, over the drill bit, during drilling operations. The sonde contains sensors to monitor various parameters such as temperature, tool pitch and roll, and battery strength, as well as a radio transmitter and antenna that emits an electromagnetic signal that is analyzed by the receiver to calculate the drill head position. This combination of sonde and receiver is known in the industry as a "walkover locating system."

The exemplary walkover sonde that is commonly used in the industry comprises a metallic and resin cylinder that contains a circuit board, transmitting antenna, and battery compartment. The circuit board contains various sub-components, including the RF transmitter, antenna, and other sensors described above. The electronics and other components on the circuit board are encapsulated in an epoxy resin to provide a singular electronics package that is water-resistant and durable.

In another embodiment of a locating sonde for deeper drilling, the sonde contains geomagnetic sensors that detect the earth's magnetic field for determination of tool azimuth. These systems made be used at depths too great to receive a signal at the surface from a subsurface transmitter. Through computer analysis of azimuth, pitch, and drill string length calculations, the sonde position may be fixed in three dimensions. In this embodiment, the sonde does not contain an antenna to transmit a signal directly to the ground surface, but instead sends the signal through a hard-wired wireline connection which is threaded through the drill string to a connection at the drill rig itself. The wireline is used for signal transmission as well as to supply power to the sonde.

Due to practical engineering constraints in smaller drilling equipment, locating sondes have been limited in size, both in diameter and length, in order to fit into common drill tooling. For bores up to approximately 80 feet in depth, the currently available sondes provide adequate signal strength for locating. However, below this depth, signal strength typically declines to an unusable level. Further, the existing sonde packaging does not permit the use of larger antennae or additional batteries to emit a more powerful signal. To date, there has not been integration between the sonde itself and the housing which encloses it in order to provide this enhanced capability.

The capabilities of this technology are evolving, and borings of greater depth and length are now feasible that were not possible previously. As a result, there is an increased need for locating equipment that has enhanced capabilities to enable locating at greater depths and longer bore lengths, and that also have longer battery life to allow greater distances to be drilled before battery failure. A locating system that allows increased battery capacity or a larger antenna array would be of benefit to the industry.

Additional developments in the industry include the use of miniaturized radio repeaters that can be embedded in the individual drill rods comprising a drill string. Such repeaters may be used to transmit a radio signal for great lengths up the interior of the drill string, which serves as a wave guide to focus the transmission. Such a system could be easily adapted to use with locating technologies intended for depths greater than typically used for battery operated sondes. Such a system would eliminate the requirement for a wireline to transmit the sonde signal to the surface, but with current technology would not eliminate the need for the wireline to supply power to the sonde.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

This presents an invention for improving the capabilities of a directional drilling locating system. The invention provides an integrated system for attaching a locating sonde to the end of a string of drill rods and system. The sonde includes locating electronics that may be securely received within a chamber formed within the sonde.

In disclosed embodiments, the one or more chambers may be provided and the electronics can include a battery, a sensor, a transmitter, an antenna and connecting wires. One or more secure windows may be provided in the sonde body to allow the locating electronics to wirelessly transmit outside of the sonde body. The electronics may be potted within the chamber with a solidifying potting agent to improve durability of the electronics in a drilling environment.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a System and Method for Installing Casing in a Blind Horizontal Well. Although the present examples are described and illustrated herein as being implemented in a horizontal system, the system described is provided as an example and not a limitation. As those skilled in the art will appreciate, the present examples are suitable for application in a variety of different types of drilling or boring systems.

Figure 1:
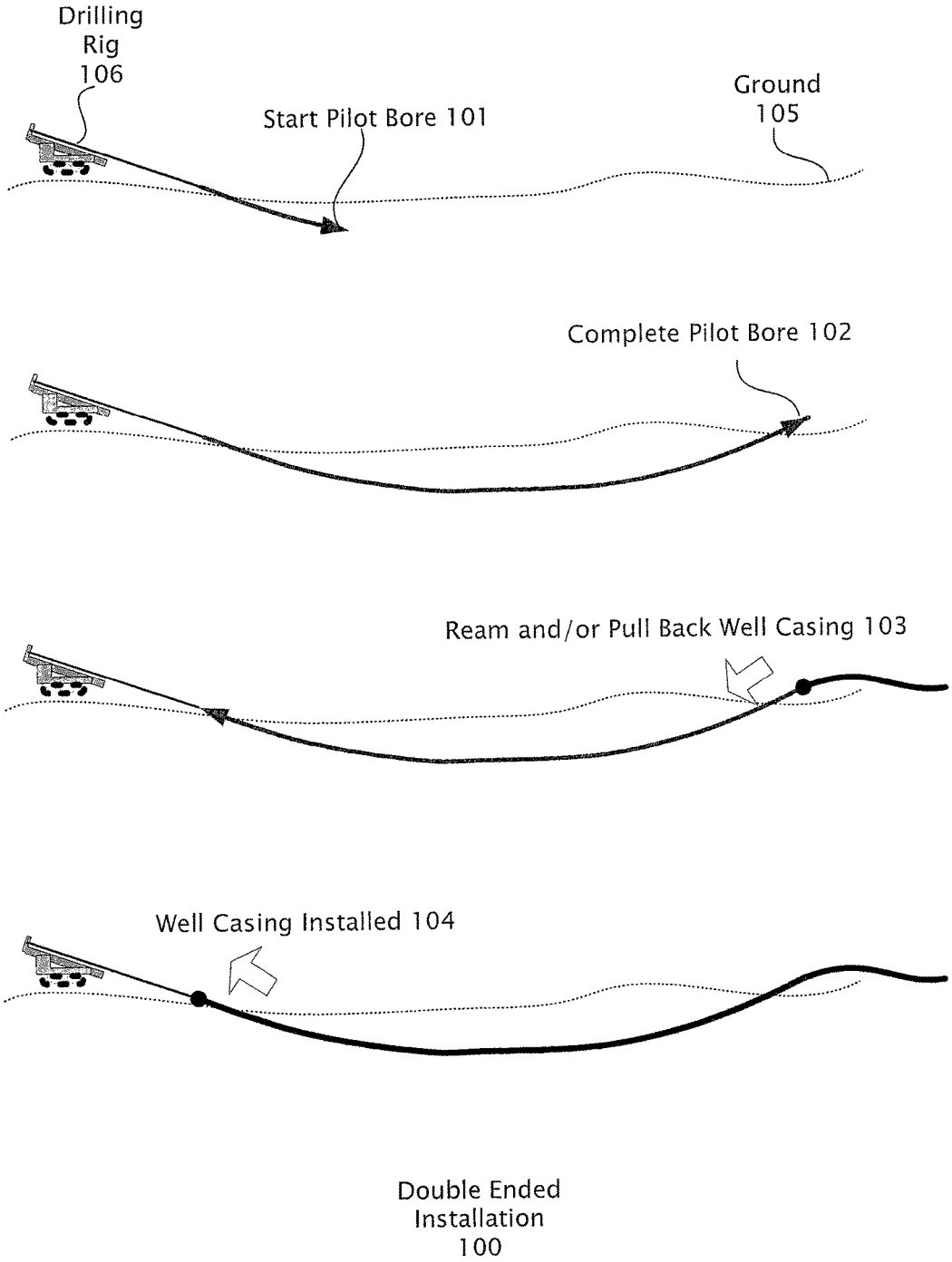
FIG. 1 shows a horizontal drilling operation.

FIG. 1 shows a horizontal drilling operation, or double ended installation, or equivalently double ended completion 100. The double ended completion drilling is shown at various stages of completion. Horizontal directional drilling may be used to install utilities and pipelines and to construct river crossings and shoreline approaches for submerged pipelines, power and communications lines and the like. Horizontal drilling may also be used to install horizontal wells for environmental projects such as the remediation of contaminated soil and groundwater, for reinjection of treated water from industrial processes, for groundwater development and the like.

In a type of horizontal directional drilling project called double-ended completion a well casing may be installed, a drill rig 106 may be situated at an entry location 101. A borehole is extended underground 105 to an exit location 102 some distance away, whereupon the drill bit (not shown) at the end of a drilling string may be detached and a swivel and reaming tool (not shown) may be attached. The product (not shown) to be installed on the bore hole (such as exemplary casing, wiring, or the like) is then attached to the swivel and the material is pulled back 103 into the exit end of the boring until it emerges at the entry end, and the exemplary well casing is installed 104.

Figure 2:
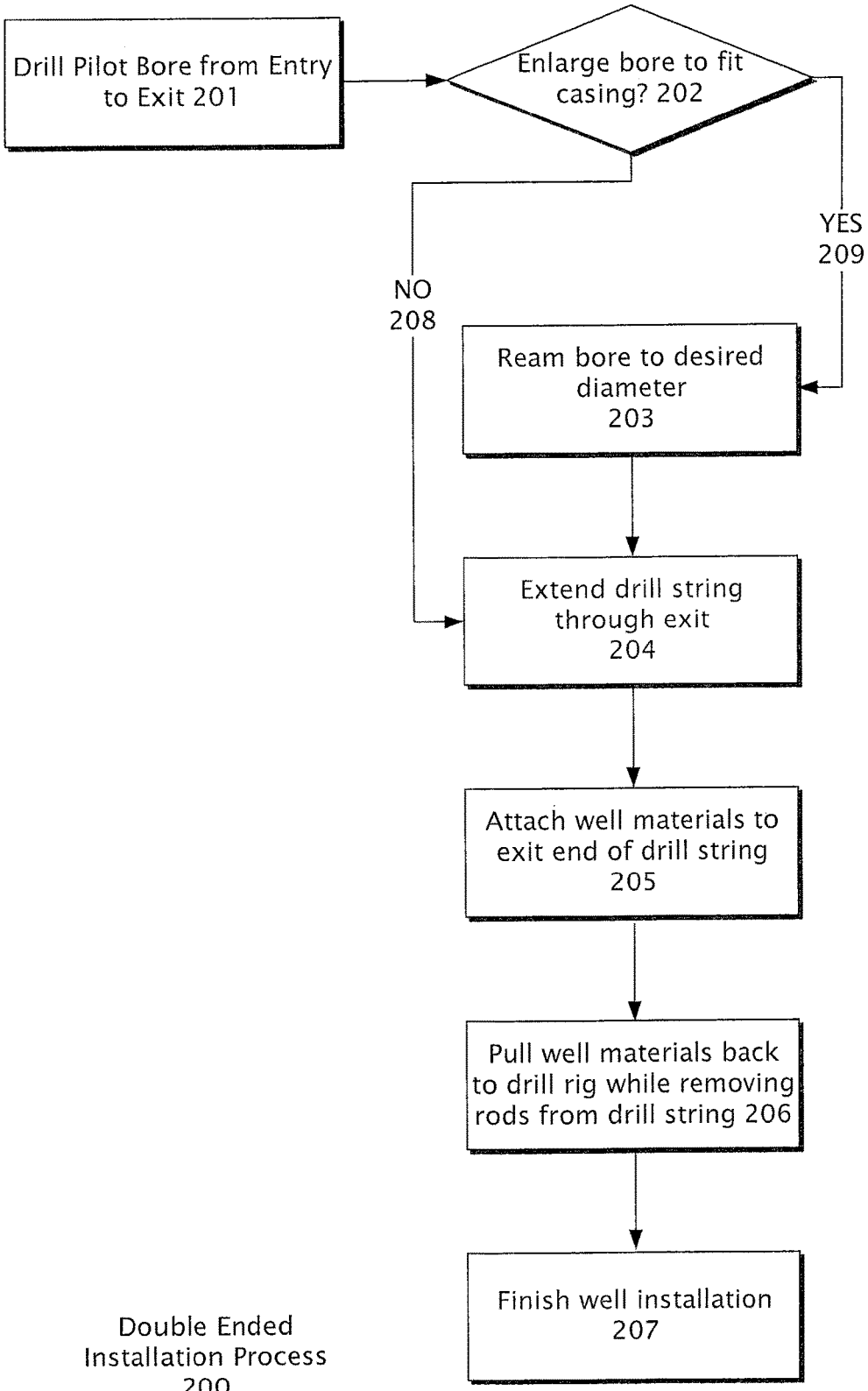
FIG. 2 shows a process for horizontal drilling.

FIG. 2 shows a process for horizontal drilling, or double ended installation. First a pilot bore may be drilled from entry to an exit point 201. Next a decision is made at 202 where it is determined if the bore needs to be enlarged so the casing may fit. If the casing will not fit, and the bore needs to be enlarged 209 than at block 203 the bore is reamed to the proper diameter before proceeding to block 204. If the bore does not need to be enlarged 208, the drill string is next extended through the bore to the exit 204. Continuing on at block 205, materials to be disposed in the well bore are attached to the end of the drilling string. Next the drilling string and attached materials are pulled back towards the drilling rig, while the rods are removed from the drilling string 206. And finally at 207 the well instillation is complete.

Figure 3:
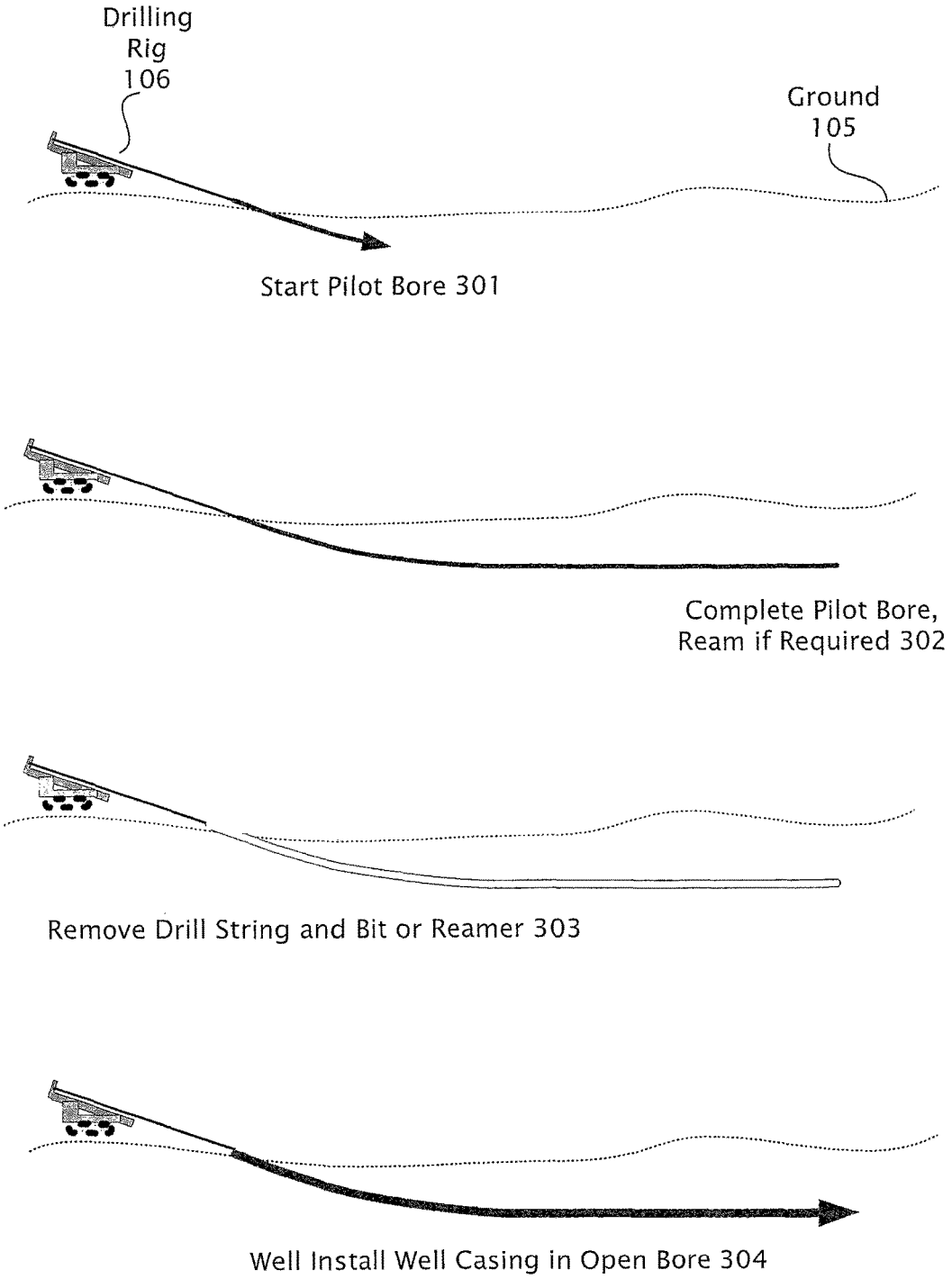
FIG. 3 shows a system for drilling and installing a well casing in a single ended completion.

FIG. 3 shows a system for drilling and installing a well casing in a single ended completion 300. The single ended completion drilling is shown at various stages of completion. In a type of horizontal directional drilling project called single-ended completion, or "blind" well completion the borehole may not exit the ground 105. Instead, the drilling rig 106, may start the pilot bore 301, with the bore drilled to some length without having exited the ground 105. After the pilot bore is complete. The bore hole may be reamed if needed 302. Next, the drilling tools that may include a drilling string or a reamer are removed from the borehole 303, and the well casing and screen are installed from the entry end 304. Such an installation procedure is similar to that for a conventional vertical well. This type of drilling may often be used for environmental projects.

Figure 4:
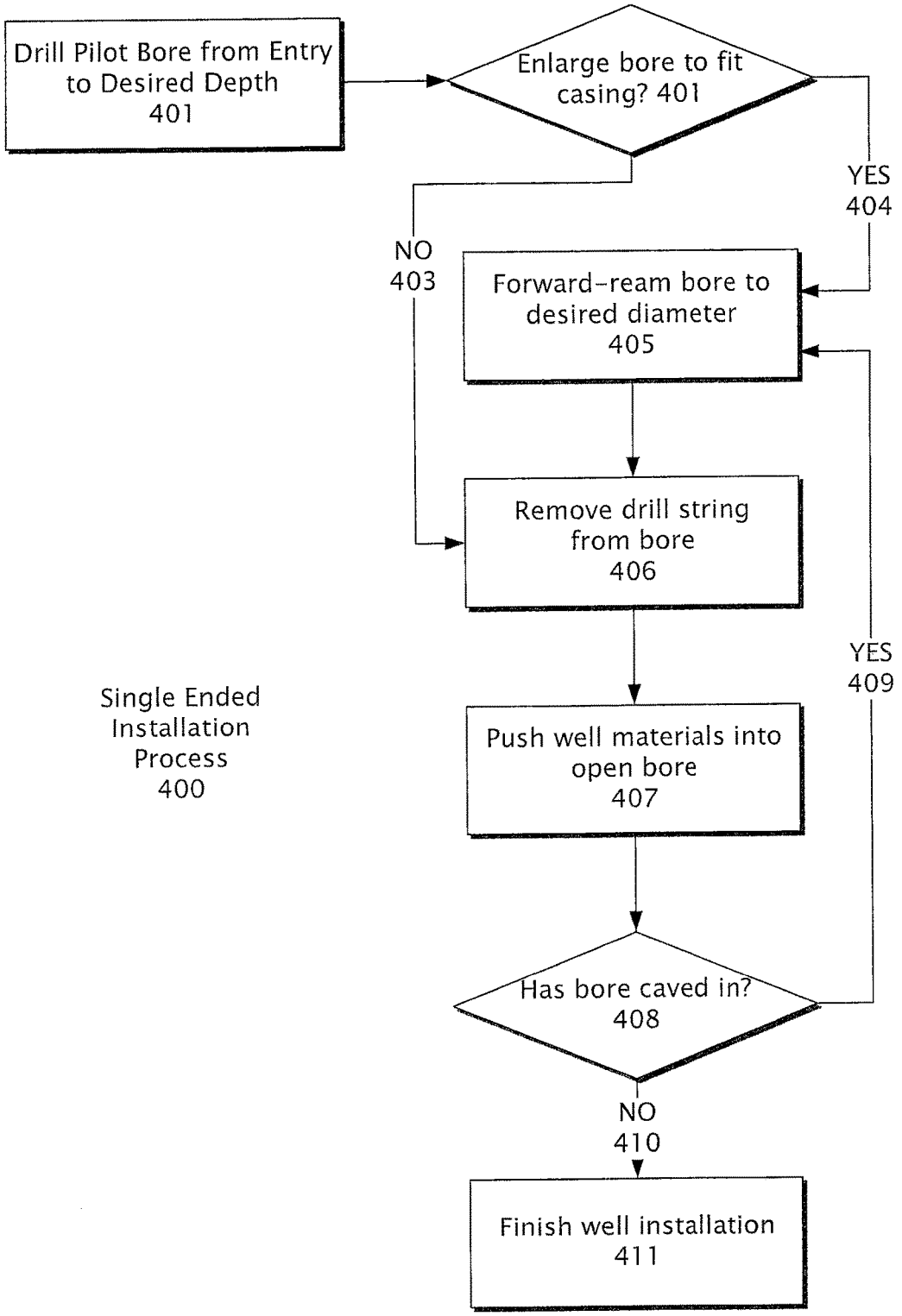
FIG. 4 shows a process for single ended completion drilling.

FIG. 4 shows a process for single ended completion drilling 400. First a pilot hole or bore may be drilled from an entry point to a desired depth 401. Next, after the bore reaches it desired depth it is determined if the bore needs to be enlarged to fit a casing being installed in the well 401. If the bore needs enlarging 404 the bore is forward reamed to a desired diameter 405. The sub process in block 406 is then executed.

Returning to block 401, if the bore does not 403 need to be enlarged to fit the casing, then the drilling string is removed from the bore 406. Well materials to be installed into the bore hole, are pushed in from the entry location. Occasionally during this process the bore hole might have caved in 408. If so 409, then the process returns to block 405, where it is repeated to open the closed bore. If not 410 then the well instillation is finished 411.

There can be problems in single-ended completion drilling. In cohesive soil materials, single-ended completion generally provides acceptable results. The borehole may remain open for a sufficient duration to allow the well materials to be inserted. However, in non-cohesive soil materials, the borehole may collapse, preventing the installation of the well materials. This may call for re-drilling the bore to a larger size, using higher viscosity drilling fluid, or other remedies that may degrade the effectiveness of the completed well.

Also in horizontal directional drilling the bore is not necessarily straight. During the drilling operation, the drilling tools can be steered by orientation of an asymmetric drill bit, guided by information received from a transmitter sonde (not shown) that is disposed in the drill string. A conventionally constructed sonde is typically positioned in-line behind the drill bit. In exemplary implementations, the sonde transmitter may be encased in a sonde housing made of steel or other suitable material, with ports machined into the housing walls to allow the transmitter signal to escape. The conventionally constructed sonde in current implementations is substantially centered along the central axis of the sonde housing.

Figure 5:
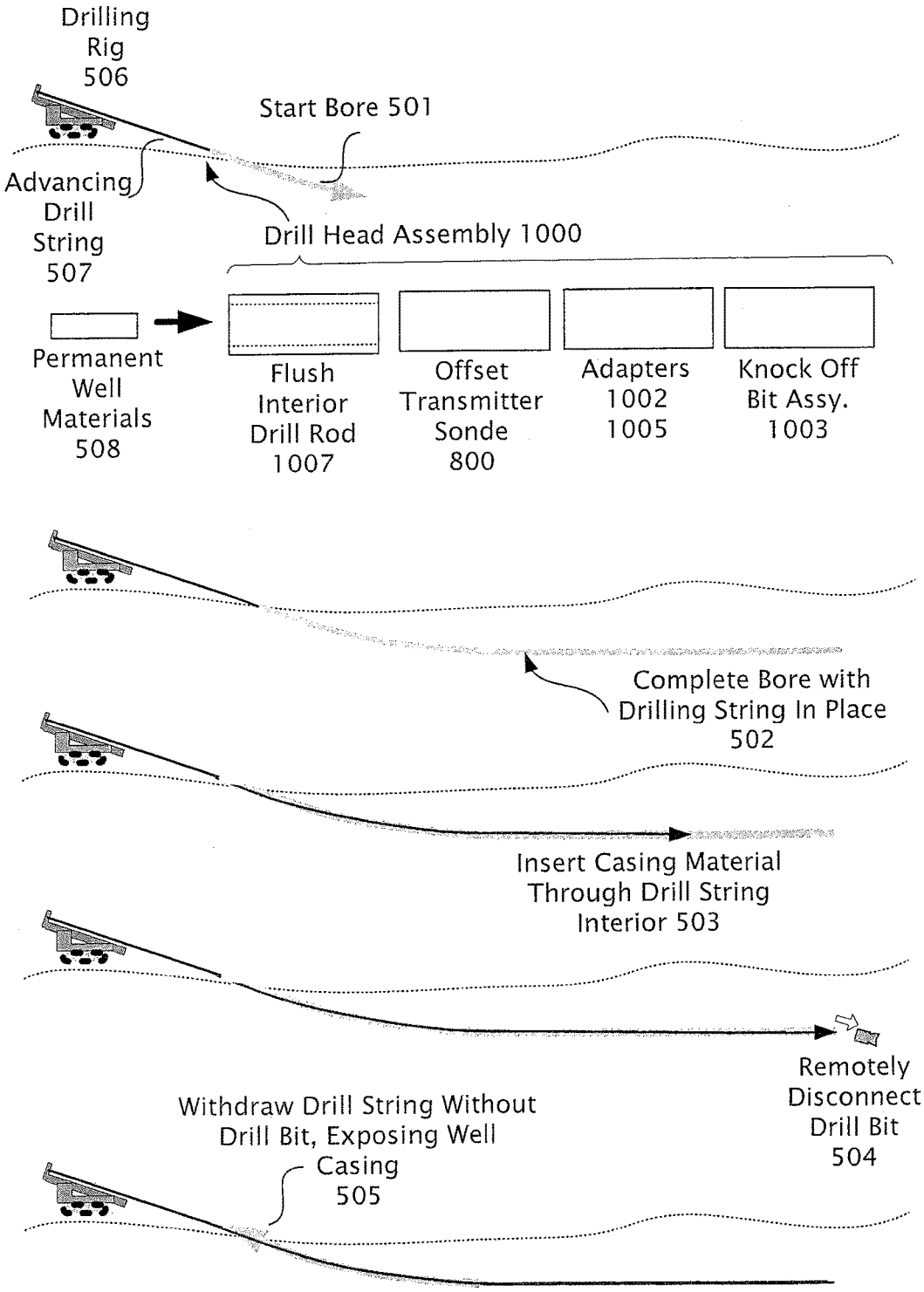
FIG. 5 shows a specially designed system for drilling and installing well casing in a single-ended completion that tends to improve drilling performance.

FIG. 5 shows a new system for drilling and installing well casing in a single-ended completion that tends to improve drilling performance by utilizing a knock off drill bit 500. This type of drilling makes use of a specially constructed drill bit assembly, that includes a drilling string with a knock off drill bit and a specially constructed sonde, to implement a new method of horizontal drilling.

The system and method also uses drill rods with an open interior passage that enables the well casing and screen to be emplaced through the drill string. The system and method also uses unique navigation sonde housing, described herein, that uses an offset sonde cavity to maintain a through passage within the sonde housing. The system and method also uses a special drill bit holder or latching mechanism, also described herein, that permits the drill bit to be detached underground after the drilling has been completed, allowing the drill string to be retracted over the emplaced well materials after they have been pushed into the drill rods.

To illustrate the specialized system and method in operation a well during various stages of completion is shown 500. As shown a drilling rig 506 with controls suitable for operation as part of the modified drilling system starts a bore 501 utilizing a knock off drill bit (shown generally at 504) coupled to the large diameter drilling string and the unique sonde housing (not shown). This is unlike the usual pilot bore where the drilling string is removed prior to installing the well casing. Here the string remains in the bore until the well casing is in place. As the bore progressed from start 501, to completion 502, the drilling rig 506 controls the drilling progress, and guides the drill as the bore is completed 502.

When the bore is completed 502, the large bore drill string remains in the pilot bore, with the hollow drill rod supporting the walls of the bore hole (unlike the conventional process where the drilling string is retracted and the walls of the bore hole may be prone to collapse). In the typical process the drilling string must be removed before casing is inserted into the bore hole because the drill bit is fixed at the end of the string and the string and drill bit must be removed to make way for the casing to be inserted in the bore as the bit cannot be removed while at the end of the blind hole. The well casing material is inserted through a cavity disposed inside of the drilling string remaining in the bore hole with the specially constructed drill bit and sonde housing remaining at the blind hole end of the bore hole. Typically, the inserted casing would block removal of the drill string with the drill bit fixed at its end. However, with the specially constructed knock off drill bit the casing may be inserted while the drill bit remains at the end of the bore 503.

Next to allow the drill string to be removed from the bore and leave the casing in place, the drill bit is remotely disconnected from the drill string and left at the blind end of the bore 504, allowing the drilling string to be removed.

The drilling string supports the casing and keeps the bore open as the drilling string is extracted 505. Once the drilling string is extracted, the casing walls are no longer shielded by the interior cavity of the drilling string, and the casing walls are then in close proximity or contact with the walls of the bore hole. Since the casing is already in place when the drilling string is removed, there are no problems with trying to insert a casing down a collapsed bore hole. As the walls of a bore hole collapsing can be a problem in the conventional process, especially in loose soil. Accordingly this system allows for increased productivity in drilling single ended completion wells, as the need for re-drilling collapsed bore holes, or even being unable to drill a bore hole in loose soil tends to be eliminated.

In exemplary operation, the driller assembles a drill head assembly 1000 including, at the far end, the knock off bit assembly 1003, coupled either directly or with an adapter 1002, 1005 to the offset transmitter sonde assembly 800. In turn, the offset transmitter sonde assembly is connected, directly or by use of an adapter, to the end of a flush interior drill rod 1007. As the borehole is advanced 501, with steering and navigation, additional drill rods (not shown) are added to the advancing drill string 507.

The drilling process continues as previously described, until the bore reaches the desired depth 502. In the current example the permanent well materials 508 that are to be left in the bore may include well screen (not shown) and well casing materials that are to be installed in the completed bore are assembled and inserted into the inside annulus of the drill rods 1007. When the permanent well materials reach the end of the drill string, they are physically manipulated by a combination of pressure and/or rotation in order to unlatch the knockoff bit assembly 1003 and may push the knock off assembly 1003 away from the end of the drill string. In this fashion the permanent well materials 508 are then enabled to exit the end of the drill string and enter the open bore. The drill rods 1007 are then extracted from the bore, leaving the permanent well materials 508 in place.

A method of creating a well described herein may utilize one or more unique components or sub-assemblies 1003, 1002, 1005, 800, 1007 which may be combined into a system, as described above, and operated in accordance with a method to produce a well.

Figure 6:
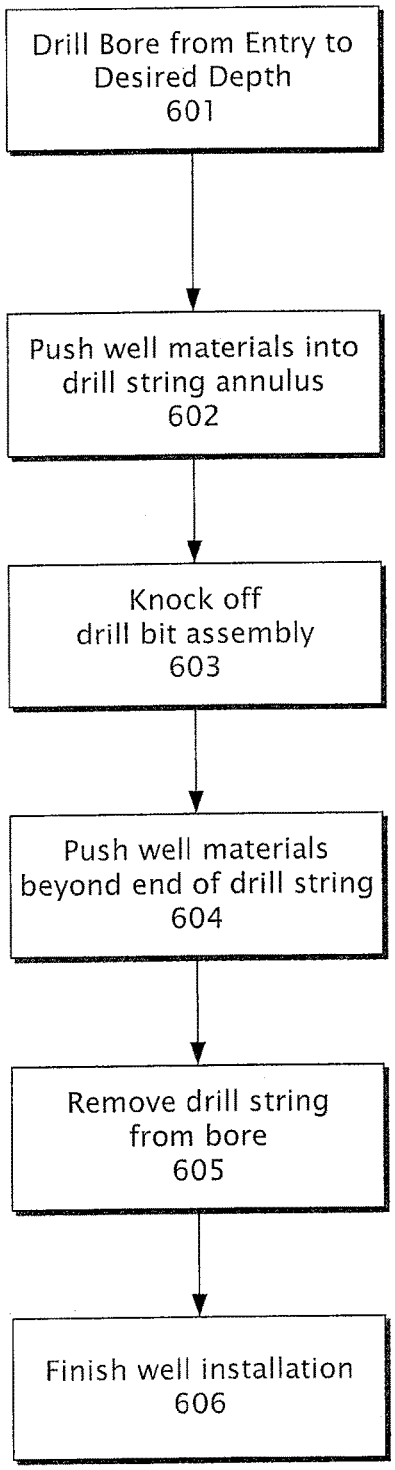
FIG. 6 is a process flow diagram showing a unique, exemplary method of creating a well utilizing the system described herein.

FIG. 6 is a process flow diagram showing a unique exemplary method of creating a well utilizing the system described in FIG. 5. First at block 601 a bore is drilled from an entry point to a desired depth with the specially constructed drilling string. At block 602 the drilling crew, with the aid of the drilling rig push or otherwise insert, or install the well casing materials through an annulus disposed in the drilling string. The casing materials are disposed in the interior of the drilling string. As the well casing materials reach the end of the bore, they encounter a latch mechanism disposed on the knock off drill bit assembly that when actuated by engagement with the well casing materials causes the drill bit assembly to disengage or otherwise uncouple from the drilling string at block 603. At block 604 the well casing materials may be used to further push the disengaged drill bit assembly, and the well materials past the end of the bore. This may be done to position an exemplary well screen, or otherwise free the end of the bore from obstruction.

At block 605 the drilling string is removed from the bore leaving the well casing in contact with the surrounding ground, and the sacrificial knock off drill bit assembly in the ground at the end of the bore hole. At block 606 well installation is completed.

In the system and method previously described, a specially constructed offset transmitter sonde assembly that contains an open central passage through which well casing can be inserted, and a specially constructed drill bit assembly that can be remotely activated to open a passage, whereby the casing can be installed in a directional drilled bore. In particular the method described above may utilize 1) an offset transmitter sonde assembly, 2), a knock off drill bit assembly and 3) a flush interior drilling string which will be described in the following paragraphs.

Figure 7:
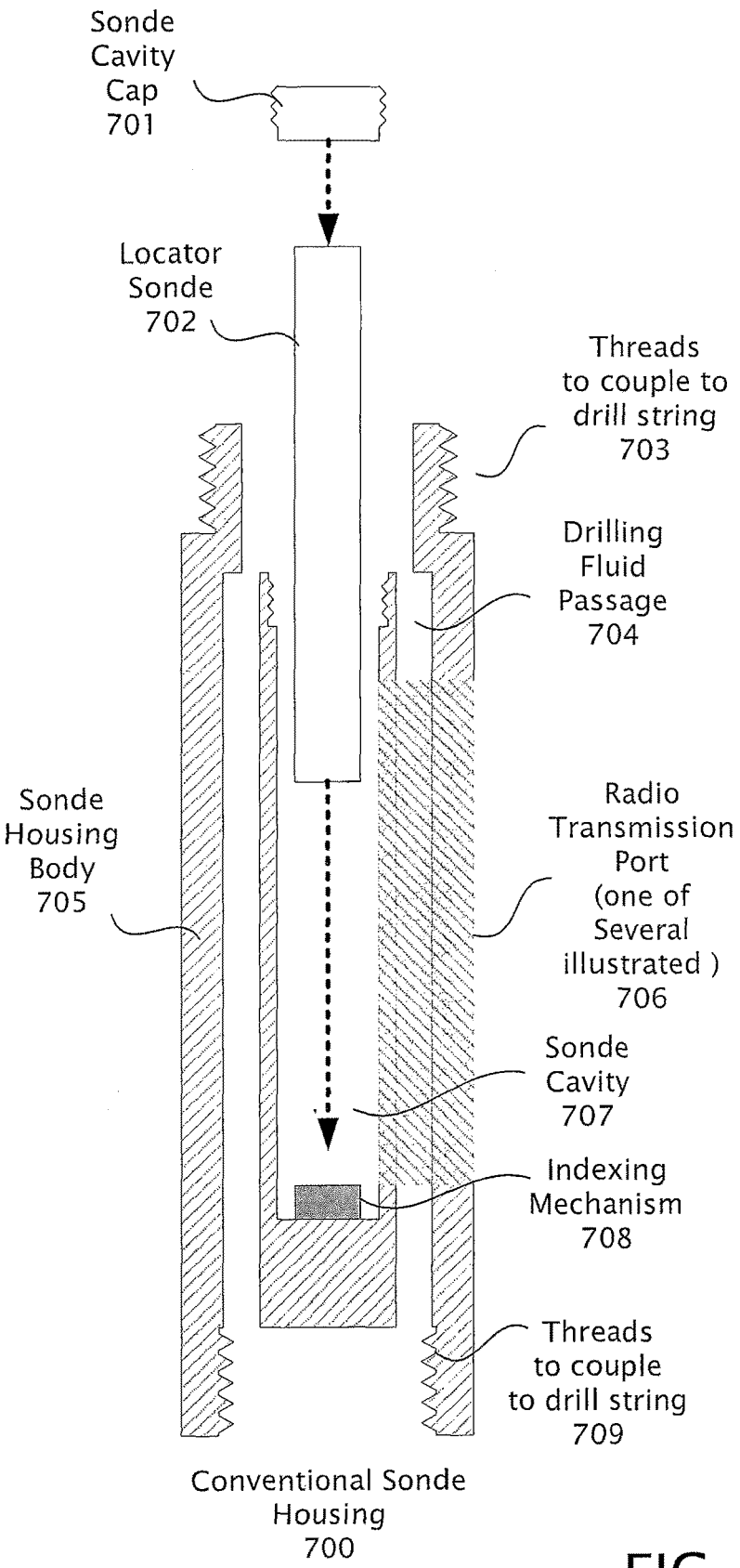
FIG. 7 shows a conventional centered sonde assembly.

FIG. 7 shows a conventional centered sonde assembly 700. In this device a sonde 702 is coaxially located in a sonde cavity 707 that may include an indexing mechanism 708. The cavity 707 may be sealed with a cap 701 to protect it from drilling fluid flowing through passageways 704, and from other contaminants.

Location and guidance of the drilling is important since the drill bit is not visible while drilling. If uncontrolled or unguided the well path can deviate from the desired path.

Various types of locating equipment may be used for locating the droll bit. A sonde, or transmitter, typically disposed behind the drill bit may register angle, rotation, direction, and temperature data. This information may be encoded into an electro-magnetic signal and transmitted through the ground to the surface so that a nearby receiver may pick up the signal. The signal is decoded and steering directions may be relayed to the drilling machine operator to change the course of the drilling.

The sonde is typically a radio frequency device, and for the radio waves to be received ports 706 are typically provided in the sonde housing 705. The sonde housing 700 may be coupled in line with the drilling string and accordingly threads 703, 709 may be provided to couple the sonde to the drilling string.

In this type of unit the locator sonde 702 is located in the axial center of the drilling string. This type of sonde is unsuitable for use with the present examples since the center location of the sonde 702, when thread coupled to the drill string 709, would prevent insertion if the well casing interior, and also interfere with the ability to use the well casing to knock off the drill bit assembly. The sonde assembly could in alternative examples be made sacrificial as well, but to save expense it is advantageous to utilize a specially constructed offset sonde assembly.

Figure 8:
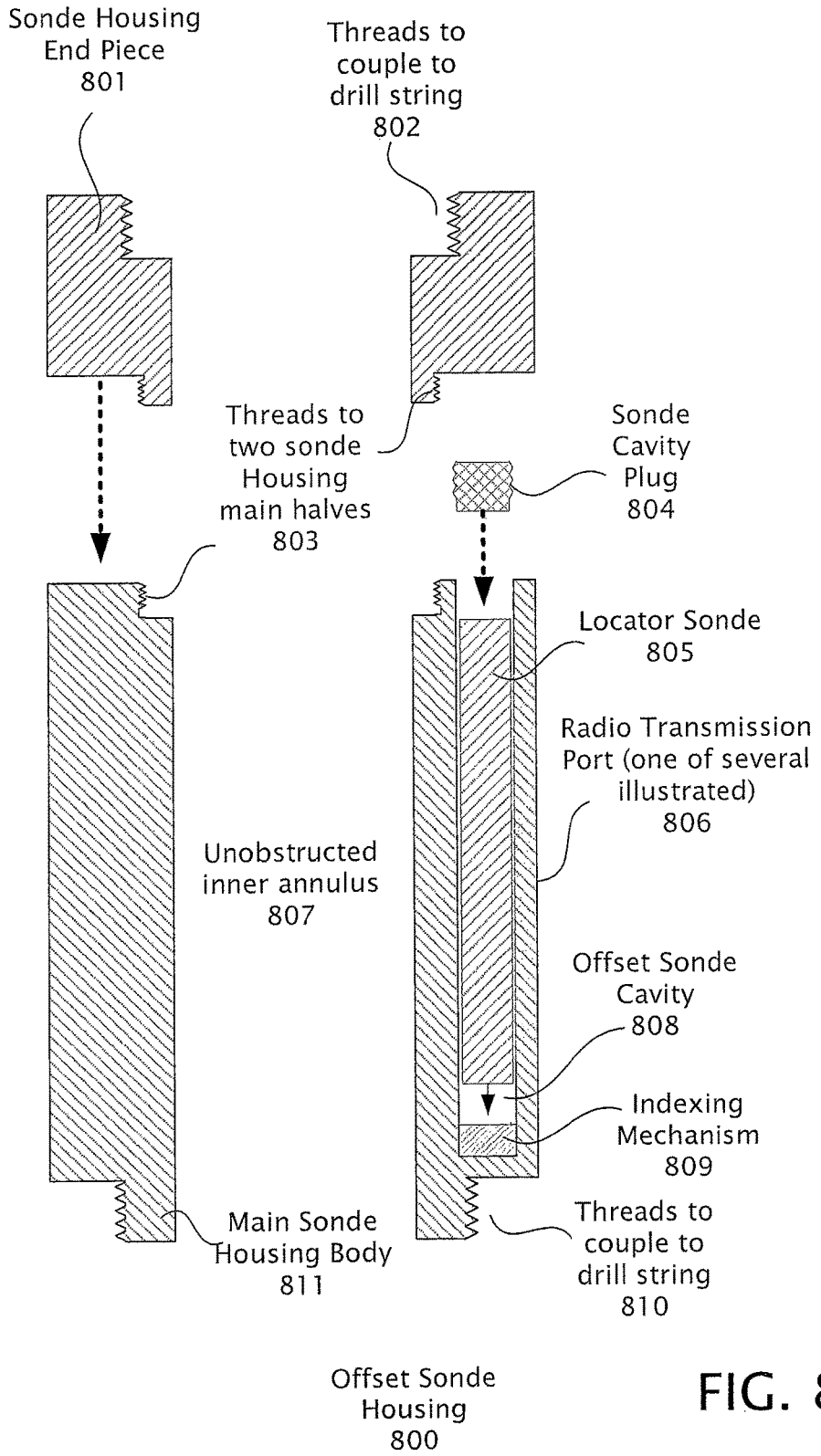
FIG. 8 shows a specially constructed offset transmitter sonde assembly.

FIG. 8 shows a specially constructed offset transmitter sonde assembly 800 suitable for use in the exemplary system. The example described herein is of a special "offset" sonde which differs from a conventional sonde housing previously described. In the current configuration, the cavity 808 which holds the locator sonde 805 is disposed within the sonde housing 811 in its exterior wall, and not at the center. Advantageously the sonde 805 is in close proximity to one or more radio transmission ports 806. The cavity is plugged 804, and an indexing mechanism 809 may be disposed in the cavity 808. This arrangement clears the center of the housing 807 so that the well casing is not blocked. The centralized sonde of FIG. 7 tends to block the advancement of tooling through the central annulus of any drill rods that are attached to it.

Various configurations of ports may be machined into the housing to permit the free flow of drilling fluid past the offset sonde 804, 806, 808, 809, through various adapters or couplers, through the drill bit assembly, and finally exit from the cutting face of the drill bit. The exemplary sonde housing may utilize a two piece housing including a sonde housing end piece 801 that may be thread coupled, or equivalently coupled 802 to a drill string. The opposite end of the end piece may include threads or their equivalent to couple to the main housing 811.

The offset transmitter sonde assembly may include a housing 811 which contains an internal passage 807 through which well casing (not shown) can be inserted, a cavity 808 in which a transmitting sonde 806 can be disposed, threaded ends 802, 810 by which the assembly can be attached to a drill string, and various passages and ports through which conventional drilling fluid, such as an aqueous based bentonite, polymer drilling fluid (not shown) or the like can be circulated and from which electromagnetic signals can be broadcast from a commercially-available transmitting sonde 805 to the exterior of the assembly 806. The sonde assembly may be constructed from any suitable material.

The sonde is located to allow the viscous aqueous fluid known as drilling mud to circulate to the drill bit. Allowance in the design is made to pump the drilling mud to the cutting head or drill bit so that it may remove cuttings, and cool the drill bit among other functions.

Figure 9:
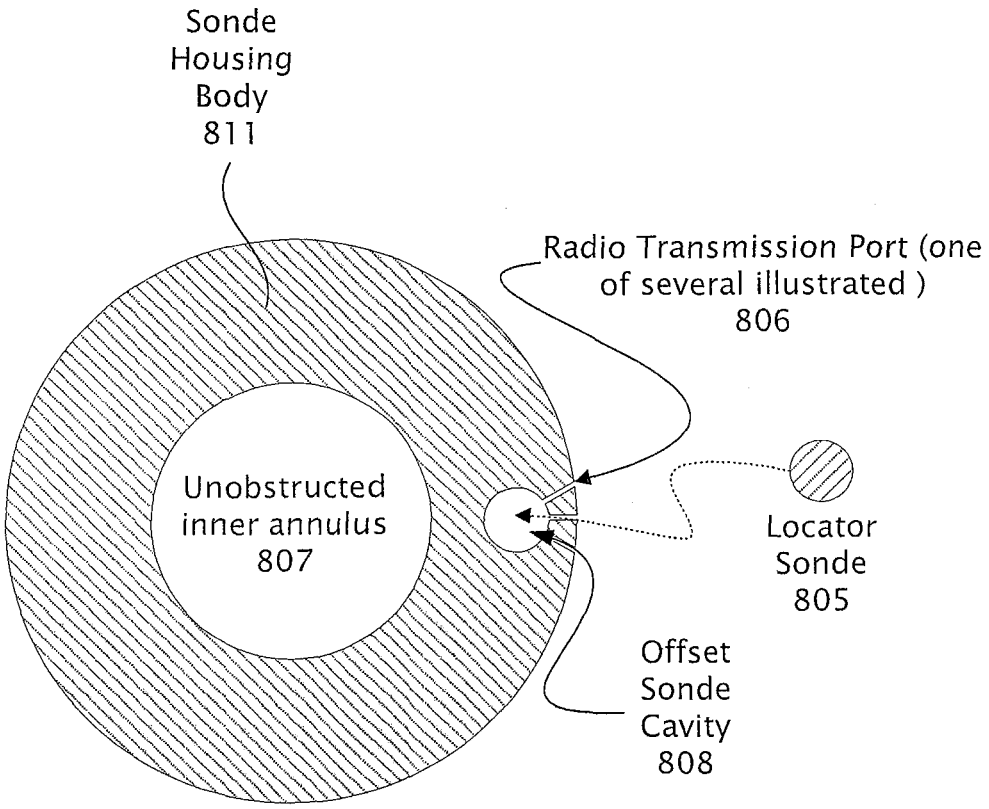
FIG. 9 shows an end view of the offset sonde housing.

FIG. 9 shows a simplified end view of the offset sonde housing 811. The offset transmitter sonde assembly 800 described enables the operator to use a commercially available locating sonde 805, disposed in an offset sonde cavity 808, and transmitting through radio transmission ports 806, with the knock off bit assembly. The offset sonde assembly 800 may be constructed such that the sonde 805 is located off the longitudinal axis of the drill string and does not block the central annulus thereof, which remains unobstructed 807. Well casing materials (not shown) can be inserted through the central annulus 807 without being obstructed by the sonde 805, which would be the case with conventional, centered sonde housing.

Figure 10:
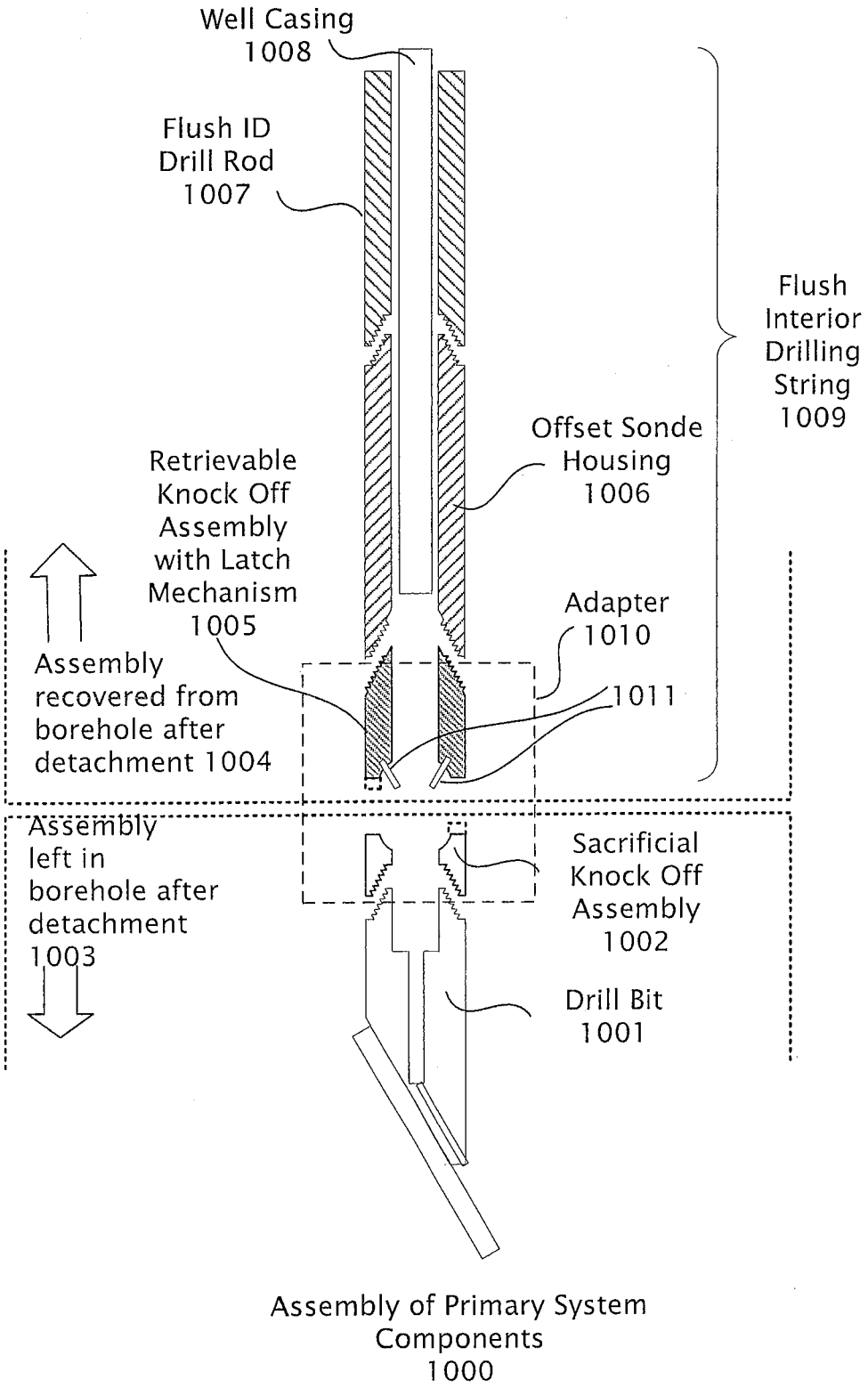
FIG. 10 shows the assembly of drill string systems components, including the adapter with latch mechanism coupling a sacrificial drill bit assembly to an offset sonde housing forming a flush interior drilling string.

FIG. 10 shows the assembly of drill string components 1000 including an offset sonde knock off drill bit assembly 1002 coupled to a flush interior drilling string 1009. The primary system components 1000, may be considered to form two major sub-assemblies; the assembly recovered from the bore hole after detachment, 1004, and the assembly left in the bore hole after detachment 1003.

The assembly recovered from the bore hole after detachment 1004 may include a flush interior drilling string 1009, includes a retrievable portion, or equivalently the retrievable knock off assembly with latch mechanism 1005 of an adapter 1010 coupled to the transmitter sonde assembly 1006 then to a plurality of individual drill rods 1007 coupled end-to-end in a continuous string going back to a drill rig (not shown). Each drill rod 1007, and the offset sonde housing contains an interior annulus, which is flush through the entirety of the string with no protrusions into the annulus. The annulus is of sufficient diameter to allow a selected well screen and casing 1008 to pass through. The adapter portion withdrawn 1005, may include a latch mechanism that is recovered.

The assembly left in the bore hole after detachment 1003 includes a sacrificial adapter, or sacrificial knock off assembly 1002, which is part of the adapter 1010 that remains in the bore hole. The sacrificial adapter 1002 couples to a detachable drill bit 1001. The sacrificial adapter may include a standard female threaded portion, into which a standard drill bit 1001 can be coupled.

The latch mechanism 1011 may be constructed in any suitable way to allow the sacrificial knock off assembly described herein to be knocked off utilizing the method of actuating knocking off the bit described herein. In the example provided herein, the retrievable knock off assembly with latch mechanism 1005 attaches to the sacrificial knock off assembly 1002 with a cam or latch arrangement 1011 which can be unlatched when desired to insert well casing. Unlatching the cam mechanism 1011 detaches the bit holder or sacrificial knock off assembly 1002 and bit 1001 from the drill string 1005, 1006, 1007, leaving it 1002, 1001 in the borehole. Unlatching is achieved by the action of inserting the well casing (and typically including a well screen) 1008 through the hollow drill rod 1007, so that when the casing 1008 reaches the latch mechanism 1011, contact with the latch mechanism 1011, disengages the latch 1011.

The construction of the latch may be provided in various alternative examples in which configurations of parts which lock in place to retain the drill bit sacrificial knock off assembly 1002, and subsequently unlock with an unlatching collar or equivalent structure to release the latch 1011, are all within the scope of this invention. For example although a latching mechanism actuated by a pushing motion has been described, in alternative examples a latching mechanism that may be caused to unlatch by rotational movement, a combination of both, or any other motion or force that may be applied to the adapter 110 may be provided. Further, the sacrificial knock off assembly 1002 may also be used to retain an end plug or other tooling, which is subsequently uncoupled to permit casing installation in a pre-drilled bore.

The adapter 1010 may be constructed to retain a standard horizontal directional drill bit or tri-cone bit 1001 while drilling, and enables the bit 1001 to be remotely detached from the assembly recovered 1004 from the bore hole when the borehole has been advanced to a target location. The assembly contains a retrievable knock off body 1005 and a sacrificial knock off body 1002. The drill bit 1001 may be threaded into the sacrificial body 1002, which is then locked into the retrievable body 1005 and may be held in place with set of splines and a latch mechanism, or its equivalent. The latch mechanism 1011 prevents the sacrificial body from becoming unlatched in normal use. The adapter 1010 can be constructed to fit virtually any drill bit diameter or thread size, or may be assembled to a standard bent sub and used with a conventional tri-cone drill bit. The assembly may be constructed of a variety of materials, including carbon steel, stainless steel, or non-magnetic alloy.

The latch may be constructed as needed to implement the disengagement process provided below.

Figure 11:
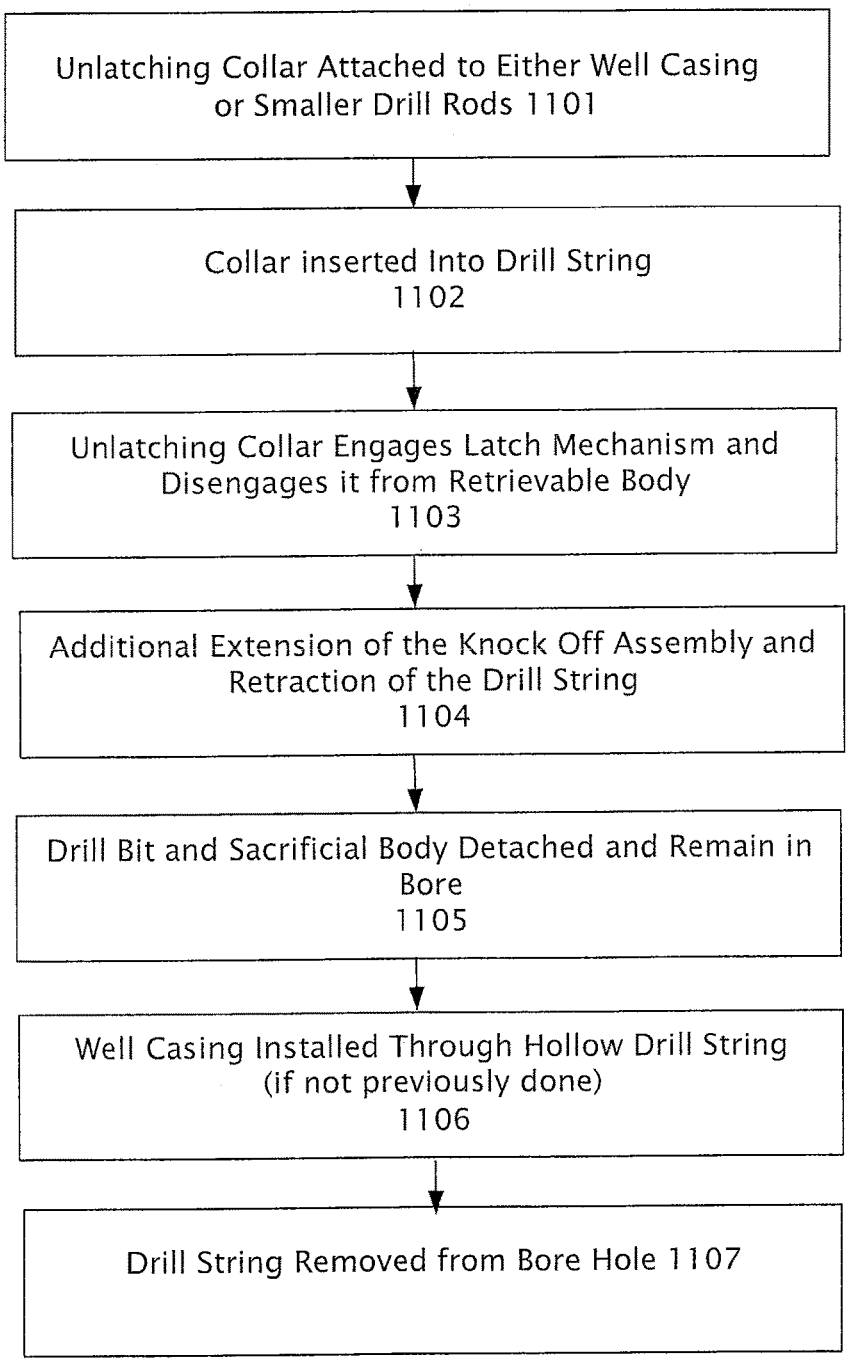
FIG. 11 is a process flow diagram for a process of detaching or knocking off a drill bit.

FIG. 11 is a process flow diagram for a process of detaching or knocking off a drill bit. The adapter is constructed to facilitate the disengagement of the drill bit remotely either by engagement with the well casing, an unlatching collar, or other such tool. For example, when it is desired to remove the drill bit from the end of the drill string, at block 1101 an unlatching collar is attached either to the end of the well casing or to a set of smaller drill rods, 1102 extended inside the drill string to put the unlatching collar in close proximity to the adapter for unlatching. The knock off tool may be inserted into the drill string at the distal end of well casing to be installed in the bore, or may be attached to a smaller diameter drill string to detach the drill bit retainer and bit prior to well casing placement. At block 1103 the unlatching collar engages the latch mechanism and unlocks it from the retrievable body. The knock off tool may be operated by a linear extension of the tool ("pushing") along the axis of the knock off bit assembly, or the retainers may be configured to require a rotational movement to unlock. In the current description, a straight linear motion is described. With additional extension of the knock off assembly and retraction of the primary drill string at block 1104, at block 1105 the drill bit and sacrificial body are detached from the end of the drill string and left in the bore as the well casing is installed (if not previously done at block 1101) at block 1106 through the hollow drill string and offset transmitter sonde assembly. Finally the drill string is removed at block 1107.

To implement this process the knock off bit assembly can be assembled in a wide variety of configurations, and with different retention components. Including the examples provided herein, the present invention includes any configuration of parts which, when assembled, enables the drill bit to be remotely removed from the end of the drill string, leaving an open bore through the base housing, through which the well casing can be installed.

The following figures will further describe the knock off mechanism and process without the offset sonde assembly present. Although in equivalent alternative examples the offset sonde assembly may be included, or excluded from the drilling string depending upon the drilling situation, and operator preferences.

Figure 12:
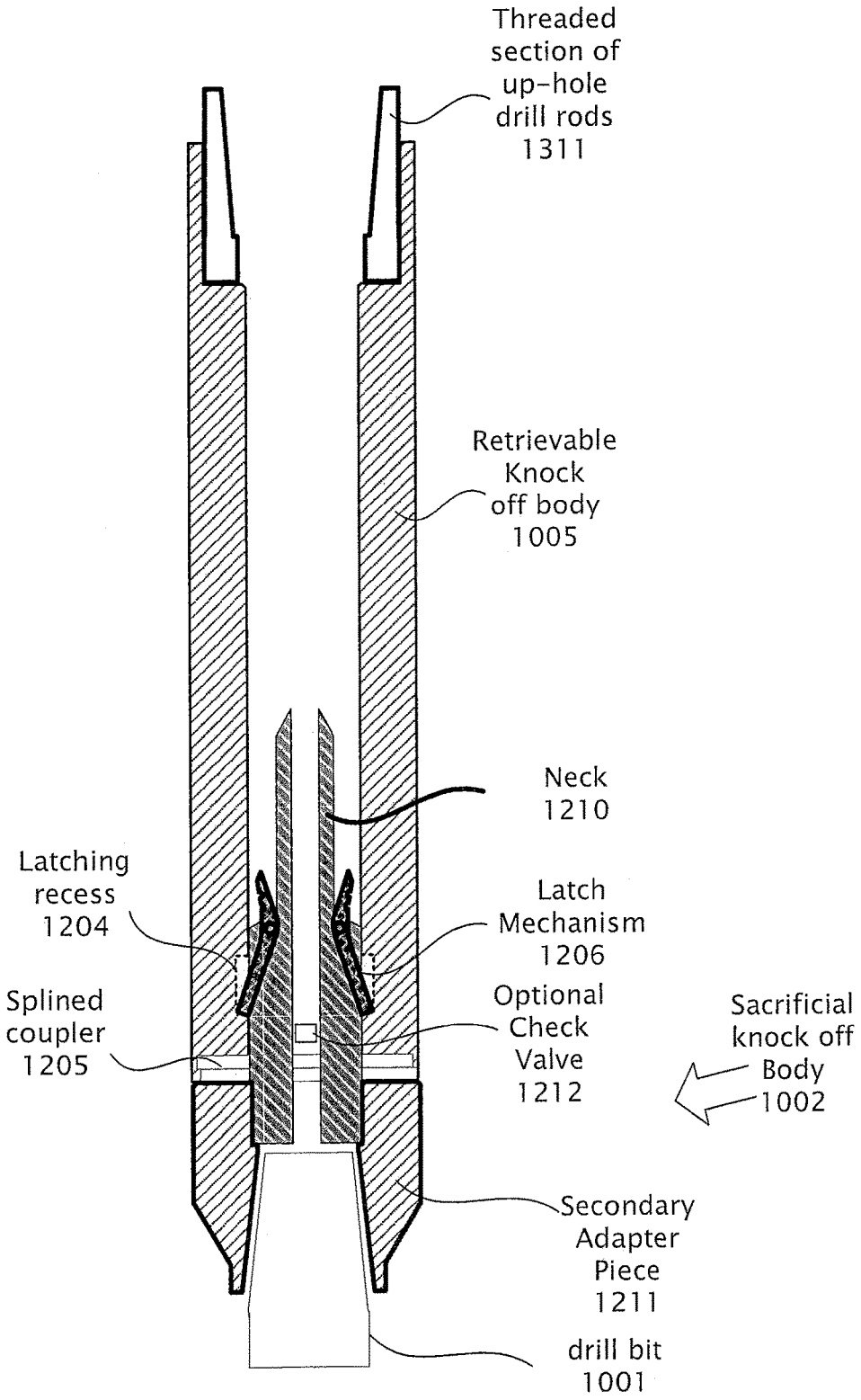
FIG. 12 shows the knock off bit assembly in the drilling configuration.

FIG. 12 shows the knock off bit assembly in the drilling configuration 1200. A drill bit assembly is provided including a novel coupling system that enables a soil or rock drilling bit and a portion of the drill bit assembly to be remotely disconnected from a drill string at a desired subsurface location. The assembly comprises a retrievable knock off body 1005 and a sacrificial knock off body 1002 to retain a bit 1001. Additionally, the adapter 1005, 1002 includes a latch mechanism 1206 that unlocks the sacrificial knock off body 1002 from the retrievable knock off body

1005, enabling the sacrificial knock off body 1002 with the drill bit 1001 coupled to it to fall free from the retrievable knock off body 1005.

The retrievable knock off body 1005 is a cylindrical tube of steel or other suitable material, with an inner diameter somewhat larger than the outside diameter of a well casing or a smaller diameter drill rod (not shown) that may be ultimately installed in the bore. At casing end of the retrievable knock off body 1005 a set of threads 1311 may be machined, and used to connect the retrievable knock off body 1005 to the end of the drill string 1311, which subsequently extends up hole to the drill rig. At the other end of the retrievable knock off body 1005 a splined coupler 1205 or its equivalent is formed in the removable knock off body 1005 and the sacrificial knock off body 1002, and include a set of radial serrations. Mating engage to mating serrations to rotatably drive the drill bit 1001. These mating serrations or teeth comprise a Hirth coupling which transfers torque from the retrievable knock off body 1005 to the sacrificial knock off body 1002, and drill bit 1001 during drilling. Inside the retrievable knock off body 1005 is a plurality of latching recesses 1204, which engage a matching set of pivotally disposed locking levers in a latching mechanism 1206 on the sacrificial knock off body 1002, to lock the Hirth, or splined coupling 1205 together during drilling operations. The serrations of the Hirth coupling which engage with the mating serrations of the retrievable knock off body 1005 are machined into the secondary adapter piece 1211.

The sacrificial knock off body 1002 may be a cylindrical tube of steel or other suitable material having a secondary adapter piece 1211 and a neck 1210 extending into the annulus of the retrievable knock off body 1005. The neck 1210, may form a guide for an unlatching collar (1303 of FIG. 13) that may slidably engage the neck to activate the latch mechanism 1206. Into the neck 1210 may be formed the latch mechanism 1206, may be pivotally disposed, and with levers coupled to latching recesses 1204 to keep the coupler 1205 engaged. It may be coupled by any suitable method to a secondary adapter piece 1211 which may include a portion of the coupler 1205, and also couples to the drill bit 1001. To couple the sacrificial knock off body 1002 to the drill bit 1001 it is threaded with industry-standard female threads. The threads engage with mating threads on a standard drill bit 1001. Alternatively, the neck 1210, and the second adapter piece 1211 may be machined or otherwise formed from a common piece of material, eliminating any need to couple two separate pieces.

The latching mechanism 1206 includes a plurality of locking levers, in which springs, and axles or pins may hold the levers in an engaged position to the recess 1204. Alternatively, the latching mechanism 1206 may be constructed to couple to the sacrificial knock off body 1002 to the retrievable knock off body 1005.

The coupler body 1005 is coupled through a threaded coupling 1311 to a drill string, comprising a plurality of connected drill rods that extend to the drill rig. As the boring is advanced, additional drill rods are attached to the drill string at the drill rig. The coupler body threaded coupling 1311 may be machined with any of several standard thread patterns. The coupling between the coupler body 1301 and the drill string may be made directly to a drill rod end, or to an adapter or sub, which may be used to adjust the length of the drill string or to adapt from one thread pattern to another. The coupler body connection may also be made to an offset sonde housing (800 of FIG. 8), which contains an electronic package that is used for locating the drill bit while drilling in order to enable steering corrections to be made.

The borehole is advanced using conventional horizontal directional drilling technology, with walkover navigation. The electronics sonde for the walkover navigation are enclosed in the offset sonde housing (not shown).

Figure 13:
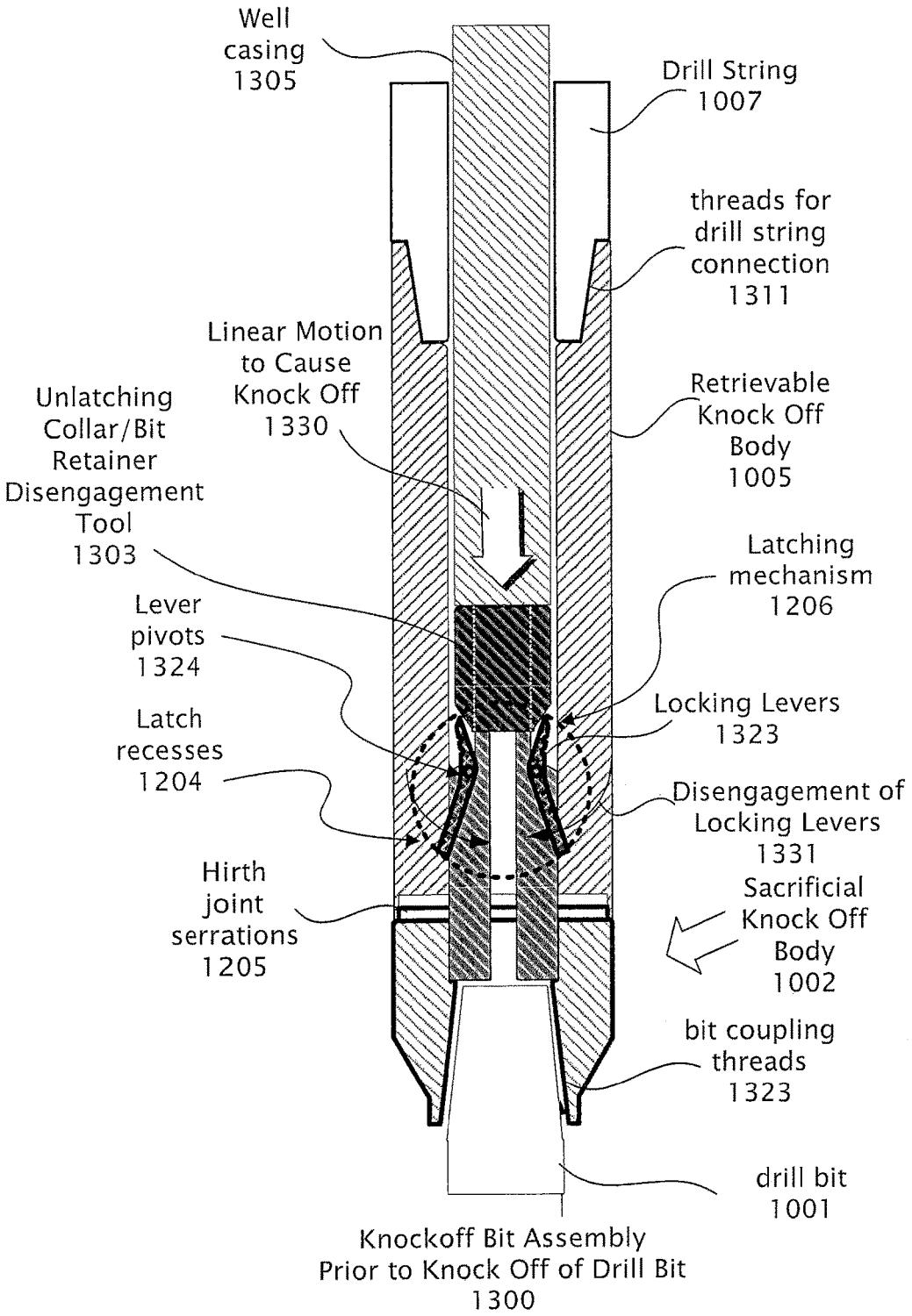
FIG. 13 shows the knock odd drill bit assembly prior to being detached, or knocked off.

FIG. 13 shows the knock odd drill bit assembly prior to being detached, or knocked off 1300. In this view a bore hole has been completed and the exemplary well casing, or smaller diameter drill rod 1305 has been inserted through the drill string 1007. At the end of the drill string may be disposed any suitable structure to uncouple the drill bit 1001 such as the exemplary unlatching collar or bit retainer disengagement tool 1303.

In knocking off the drill bit linear motion 1330 transmitted through the well casing by an operator, causes the unlatching collar 1303 to engage the neck of sacrificial knock off body 1002 where the collar 1303 is guided outwardly engaging the ends of locking levers 1323 through force exerted by the collar 1303. Locking levers 1323, are generally linearly formed structures, and are pivotally coupled to sacrificial knock off body 1002. On the side of the pivot 1324 opposite to that being outwardly engaged by the unlatching collar, the lever extension is forced inwards 1331, to disengage the sacrificial knock off body 1002, since that end of the locking lever 1323, had previously been engagedly coupled to a recess 1204 disposed in the retrievable knock off body 1002. The discussion above has focused on describing the operation of a single latch however it is understood that a plurality of latching mechanisms may be present, and operable at the same time.

Figure 14:
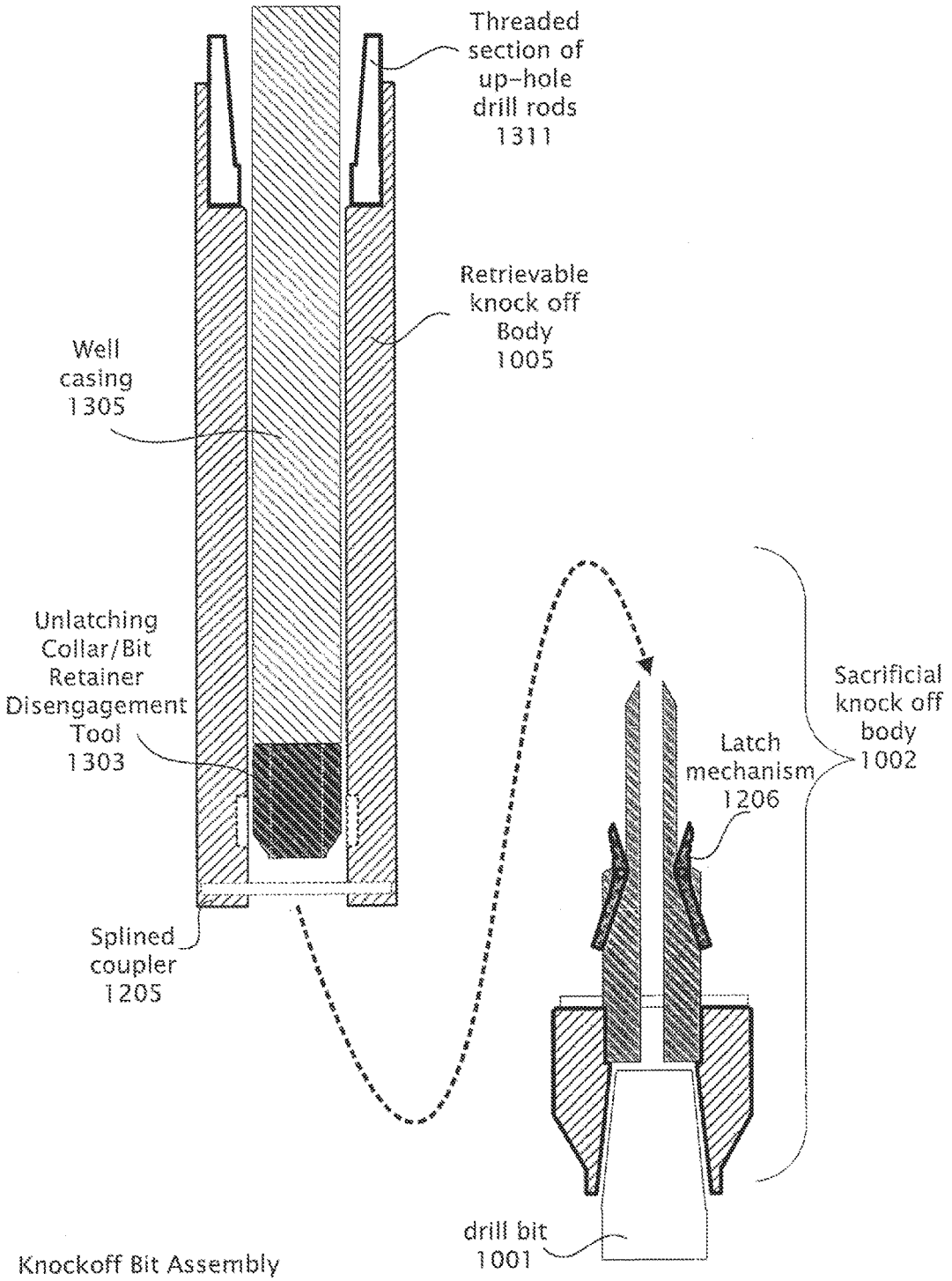
FIG. 14 shows the knock off bit assembly knocked off or detached from the drilling string.

FIG. 14 shows the knock off bit assembly knocked off or detached from the drilling string 1400. The well casing 1305, with the unlatching collar 1303 disposed at its end, has disengaged the sacrificial knock off body 1002, by uncoupling latch mechanism 1206, through it's being pushed through the interior of the well casing 1305. Once detached the well case, may be pushed further so that the end of the bore is somewhat cleared. The well casing 1305 may be retracted as needed to distance it from the sacrificial knock off body 1002 remaining in the bore hole. Finally the hollow drill rod covering the well casing may be removed, leaving the well casing disposed in the well bore.

In the description herein horizontal is generally taken to mean generally having more run than rise (45 degrees or less elevation from I level plane). However, horizontal as used in describing the boring angle capable of being created by a horizontal drilling machine, and may include bores of a constant bore angle, or bores that change their angle, such as those that may be created by first drilling at an acute angle with the ground surface, and are then caused to level off to a substantially horizontal angle.

Referring to FIGS. 15-19, a multi-chamber sonde housing 1500 having one or more additional chambers 1502 received therein is disclosed. These chambers 1502 offer an improved way of arranging the components of a locating system, as well as an improved way to contain those components at the end of a set of drill rods down a bore hole.

Figure 15:
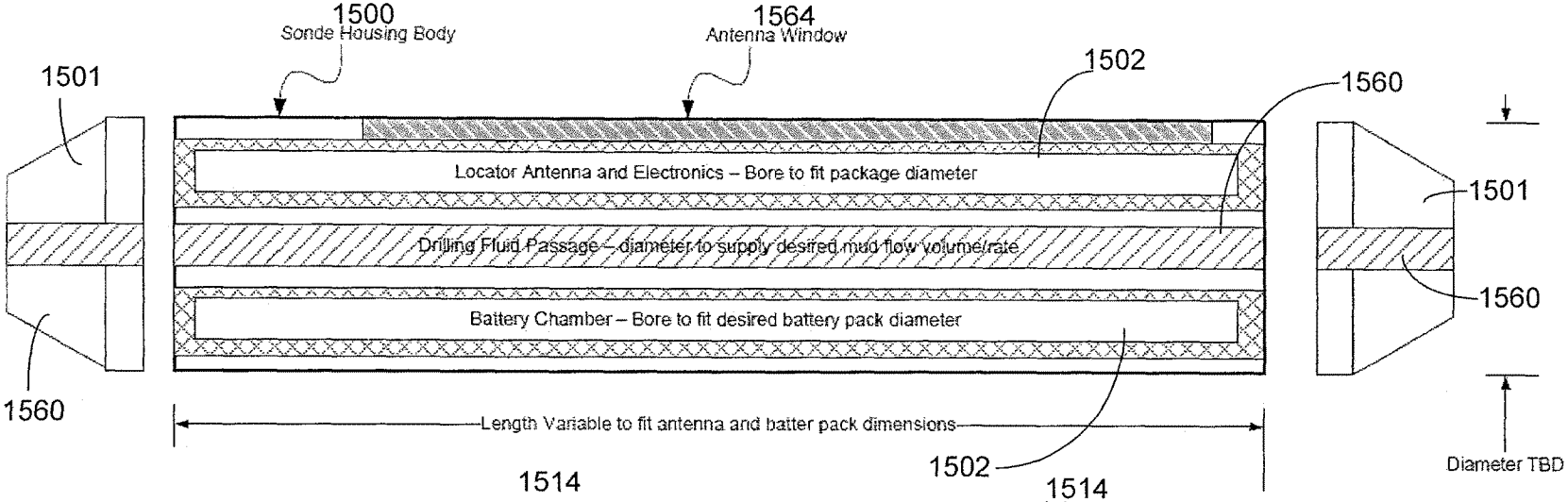
FIG. 15 is an exploded, longitudinal cross-sectional view of a sonde in accordance with an embodiment of the present invention.

In FIG. 15, a rigid housing 1504, such as a steel or the like, is attached to the end of the drill string, between the drill bit and the drill rig. The housing has one or more chambers 1502 formed into it, such as by drilling or the like, with end caps 1501 operably secured at each end as shown. The locating transmitter 1510, within the sonde, is divided up into various component modules—the electronic circuitry 1512, one or more antennas 1514, and one or more battery packs 1516—and the modules are inserted into the chambers 1502 and connected together appropriately with connecting wires 1518 or the like.

Figure 16:
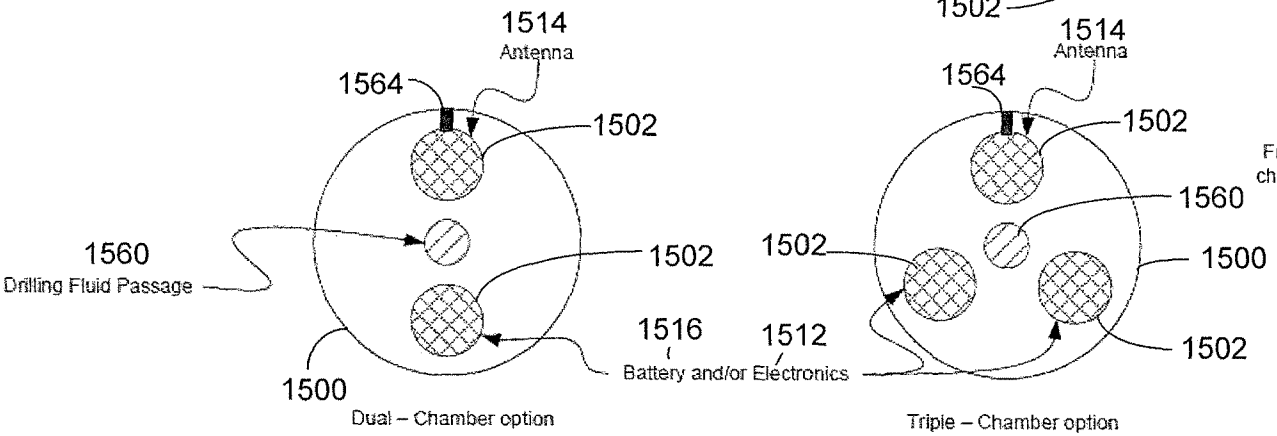
FIG. 16 is a cross-sectional view of the sonde of FIG. 15 taken along line 16-16 of FIG. 15.
Figure 17:
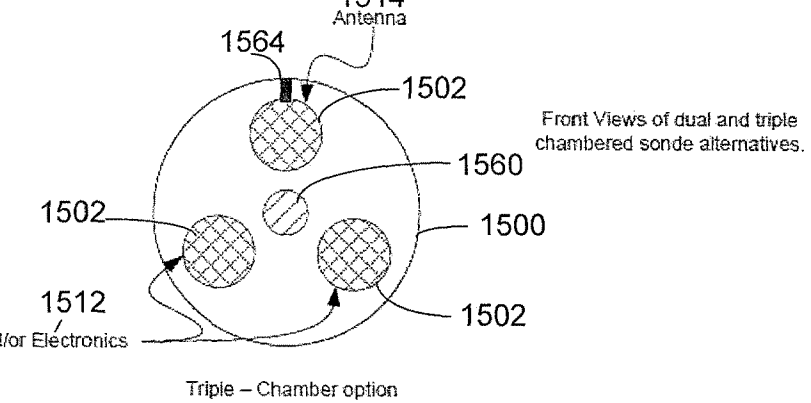
FIG. 17 is a cross-sectional view of an alternative possible sonde assembly showing an alternative possible triple internal chamber option.

The number of chambers 1502 within the sonde housing 1500 can be as many or as few as required. FIGS. 15 & 16 show two chambers 1502 received therein. FIG. 17 shows three chambers 1502 received therein.

Figure 19:
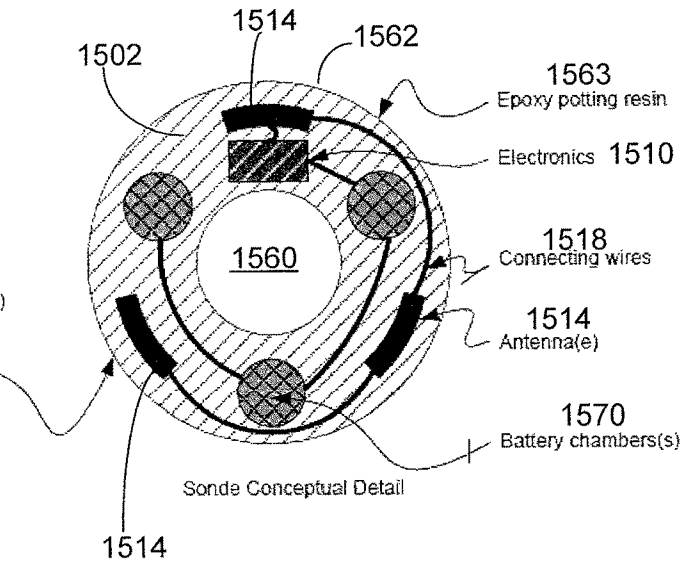
FIG. 19 is a cross-sectional view of a third alternative possible sonde assembly showing a third alternative possible internal orientation of components within the sonde chamber.
Figure 18:
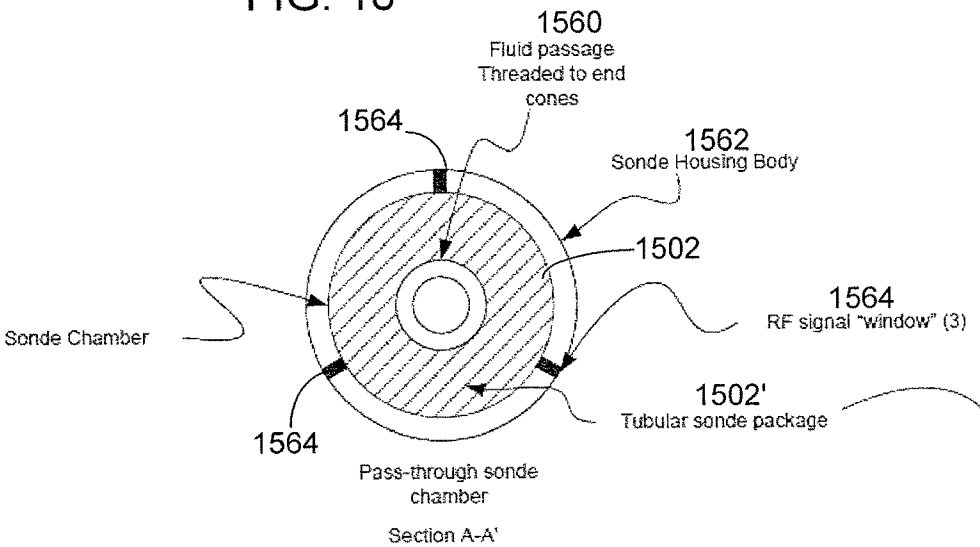
FIG. 18 is a cross-sectional view of a second alternative possible sonde assembly showing a second alternative possible pass-through sonde chamber.

Referring to FIGS. 18 & 19, the sonde housing 1500 may be a large hollow cylinder. The interior shaft 1560 that goes through it is designed to be strong enough to handle the stress of drilling. The large, hollow chamber 1502' that surrounds it contains the sonde transmitter. The outer part 1562 of the sonde housing 1500 primarily provides protection for the sonde, has windows 1564 in it that are transparent to radio and magnetic signals such as high-strength plastic or boron glass or carbon fiber or the like. The sonde (the combined electronics, antenna and battery power) are cast or potted into a single module, preferably with a hardening filler 1563 such as epoxy potting resin or the like, shaped like an elongate donut—which slides into this chamber. In this embodiment, the advantage is that all of the electronic parts are already connected and placed into predetermined positions so there is less likelihood if installation error and few electrical connection problems in the field because it is solid state. The only moving parts are the caps on the battery chamber 1570.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A drill assembly comprising:

a drill body coupled to a drilling string;

an elongate sonde body having a longitudinal length, the sonde body operably secured to the drill body, said sonde body having at least one chamber defined therein and a through shaft extending along the longitudinal length of the sonde body, the at least one chamber extending from a first end of the longitudinal length of the sonde body towards a second, opposite, end; and, the at least one chamber receiving locating electronics therein.

2. The drill assembly of claim 1, wherein said sonde body is substantially cylindrical.

3. The drill assembly of claim 1, wherein there are at least two chambers defined therein.

4. The drill assembly of claim 1, wherein there are at least three chambers defined therein.

5. The drill assembly of claim 1, wherein said at least one chamber is formed by drilling into the sonde body.

6. The drill assembly of claim 5, wherein said at least on chamber encircles said through shaft.

7. The drill assembly of claim 1, wherein said at least one chamber is positioned between the through shaft and an outer surface of the sonde body.

8. The drill assembly of claim 1, wherein said locating electronics are selected from a group consisting of a battery, a sensor, an antenna, a transmitter and a connecting wire.

9. The drill assembly of claim 1, wherein said sonde body has an outer surface and said outer surface includes a secure window to the at least one chamber for allowing wireless communication to pass from the chamber out of the sonde body.

10. The drill assembly of claim 9, wherein said window is formed from materials selected from the group consisting of high strength plastic, boron glass, and carbon fiber.

11. The drill assembly of claim 1, wherein the electronics are potted within the at least one chamber.

12. The drill assembly of claim 1, further including a hardening filler operably received within the chamber to hold the locating electronics securely in place within the at least one chamber.

13. The drill assembly of claim 1, further including at least one end cap detachably secured to the sonde body.

14. The drill assembly of claim 13, wherein said end cap has a through hole aligned with the through shaft of the sonde body.

15. The drill assembly of claim 1, wherein said sonde body is formed of steel.

* * * * *